US005495983A

United States Patent [19]

Lelek

[11] Patent Number: 5,495,983

[45] Date of Patent: Mar. 5, 1996

[54] SHIPPING AND STORAGE CONTAINER WITH INTEGRAL DIVIDER INSERT

[76] Inventor: Gregory A. Lelek, 9662 Indian Creek Way, Escondido, Calif. 92026

[21] Appl. No.: 187,857

[22] Filed: Jan. 28, 1994

[51] Int. Cl.[6] ..... B65D 25/04

[52] U.S. Cl. ..... 229/120.13; 229/120.21; 229/120.28; 229/194; 206/315.2

[58] Field of Search ..... 229/120.08, 120.13, 229/120.18, 120.21, 120.24, 120.26, 120.28, 194, 165, 166; 206/315.2

[56] References Cited

U.S. PATENT DOCUMENTS

| | | | |
|---|---|---|---|
| 584,072 | 6/1897 | Church | 229/120.18 X |
| 2,854,181 | 9/1958 | Smith | 229/120.08 |
| 2,948,455 | 8/1960 | Frankenstein | 229/120.21 |
| 3,115,290 | 12/1963 | Byassee | 229/120.18 X |
| 3,184,142 | 5/1965 | Rosenburg, Jr. | 229/120.18 |
| 3,804,321 | 4/1974 | Forbes, Jr. | 229/120.28 X |
| 3,933,300 | 1/1976 | Dempster | 229/194 X |
| 4,265,391 | 5/1981 | Zornes et al. | 229/194 X |
| 4,294,397 | 10/1981 | Kohler | 229/120.08 |
| 5,049,710 | 9/1991 | Prosise et al. | 229/120.21 X |

*Primary Examiner*—Allan N. Shoap
*Assistant Examiner*—Christopher J. McDonald
*Attorney, Agent, or Firm*—James T. FitzGibbon

[57] ABSTRACT

A container has partitions that are formed from panels that are connected to the sidewall of the container. These panels have a reduced length relative to the length of the container. The shortcoming allows for a space for the heads of golf clubs to be shipped in the container. The sidewalls are formed by four panels that interlock with one another to form a rigid sidewalls. The copntents are easily loaded form the top of the container when the top panel is open.

13 Claims, 3 Drawing Sheets

SHIPPING AND STORAGE CONTAINER WITH INTEGRAL DIVIDER INSERT

The present invention relates generally to shipping and storage cartons, and more particularly, to a form of shipping carton adapted to a specialty use such as protecting golf clubs for transient storage and for shipment by common carrier.

In recent years, article packaging has been forced to meet a number of requirements that heretofore did not exist or were of relatively minor importance. As a consequence of these changes in circumstance, containers for almost every type of application are required to possess a more stringent combination of advantages and features than were heretofore considered necessary. Both from the standpoint of customer requirements, which include economy and reliability, and for extrinsic reasons, such as government, environmental, and/or shipping regulations, the packaging industry has been required to overcome new and difficult problems.

Today's packaging customers include many producers of specialty products, whose kind and character requires meeting these diverse but important requirements. Among these are the primary requirements of having strength and durability adequate to protect the packaged articles against damage of foreseeable kinds. In addition, low cost has traditionally been a requirement of a desirable container. However, with the passage of time, increased specialization and, in some cases, cost of packaged products, particularly consumer products, has underscored additional needs that containers should be able to meet, if possible.

These include a requirement for uniformity, in the sense that each package within a large number of packages should be as close to identical as possible relative to other packages in the group in the important properties of weight, protection, and ease of fabrication. It is important that variations in the ability to meet the shipper's requirements be minimized. One example of where lack of uniformity can affect reliability is in the area of composite packaging, i.e., packaging in which the product is packaged in an outer container within which other protective material is provided. Variation in article protection can occur in these conditions, and is usually attributable to questionable specification or labor-related factors.

Thus, where filling a package requires a certain amount of skill or judgment, the effectiveness of the finished package is dependent on the exercise of that skill or judgment by the worker. Therefore, if all the workers are not equally skilled or careful, there can be a significant variation in a run of packages intended to be otherwise identical.

Naturally, in the interest of economics, if filling a package and surrounding it with protective material is time-intensive, cost will be comparatively high. By the same token, if the package interior is occupied by a so-called "loose fill" product, then over-filling is unduly expensive, and underfilling creates questionable protections.

If loose fills are used, the packaged article can sometimes be placed improperly within the package, thus compromising protection. Where there is significant variation between otherwise similar packages, quality assurance could be difficult or problematical. In instances wherein the cost of the product is high, packaging reliability becomes even more important to the seller.

One example of a product which has created packaging problems is that of golf clubs. Today, it is not unusual for a set of golf clubs to cost several hundred dollars up to $1,000 or more for a set of three or four "woods" and seven to nine "irons". Particularly with the advent of so-called "metal woods", i.e., club shaped like traditional wooden headed clubs, but actually made from metal, a rather intricate manufacturing process and the traditional requirement for a high quality finish have combined to create a product that is very desirable but highly expensive. Purchasers of such products are often extremely particular about the appearance of such products and accordingly, it is virtually impossible to obtain the full price for a set of clubs in which even one of the clubs is damaged. This is true regarding even superficial appearance damage occurring during shipment.

Damage-free appearance is particularly important in golf clubs which are matched not only in sets, i.e., as to model, but wherein the shaft length, stiffness, lie of the club and swing weight factors all combine to make replacement of an individual club within a matched set difficult and time consuming. In other words, if even one club of a matched set is damaged, the whole set must be sold for a greatly discounted price or the set must await replacement of one of the clubs in the set. Such damage is therefore magnified somewhat out of proportion to the type of damage that might occur with products not being marketed in matched sets of precise character.

Referring again to the golf club manufacturing industry, it has been common to ship golf clubs in packages wherein shock cushioning and club positioning within an exterior container have been carried out by filling an exterior container with an auxiliary or second material, and certain amount of so-called loose fill product, inserting the clubs, sometimes thereafter filling the remainder of the package with the remainder of the packaging. [Modern day loose fill materials are typically those made from expanded polystyrene (EPS) or other chemical foam materials.] In some cases, golf clubs were packed in wadded paper, such as craft or newsprint. However, as pointed out above, this approach renders the package susceptible of worker-determined variation and is undesirable. Moreover, this form of packaging from the material standpoint has not provided adequate protection. Bubble packaging or foam sheet has proved expensive and provided inconsistent packages. Two other types of packaging have often been used for golf clubs, one being molded foams and the other being so-called fabricated foam, i.e., styrene or urethane foam cut into strips or other shapes. Molding shapes for each club is often unduly expensive. Cut or fabricated foam strips or the like are often glued into the shipping cartons to prevent shifting. This arrangement creates recycling difficulties, i.e., adhesive attachment of foam to paper. Thus, if a package is made from a variety of materials that are not readily separable, the disposition or recycling may be rendered difficult or problematical.

Under these circumstances, an ideal package for golf clubs would be one that is able to be manufactured at low cost, erected simply, filled with the golf clubs or like product and closed in a simple operation. Such a container, particularly one containing means for positively positioning the clubs against movement during shipping would be very desirable. It would also be very advantageous to provide a container which is easy for the container manufacturer to produce and which is capable of ready recycling.

In view of the failure of the prior art to provide a packaging carton for storage and shipment having the requisite combination of advantages, it is an object of the present invention to provide an improved storage and shipment container for specialty products.

Another object of the invention is to provide a composite storage and shipment container which can be manufactured at low cost and which can be made from readily available, easily recyclable materials.

Yet another object of the invention is to provide a shipping and storage container which can be erected by low cost labor and filled with a product which is thereupon precisely located and retained in place by contact with portions of the container assembly.

A further object of the invention is to provide a storage and transport container which includes an insert for dividing the container into two or more compartments that are separate from each other and which serve to positively locate the shipped product and any accessories or other material.

Yet another object of the invention is to provide a storage and transport container made from a single blank of a material such as corrugated paperboard, and which includes separate groups of panels adapted respectively to provide a container section, a cover section and a divider insert for positioning and securing the packaged articles within the container.

A further object of the invention is to provide a container of the type just described wherein the divider insert portion is attached by a hinge or fold line to the container and whereby the insert portion may be positioned within the open interior of the carton before the carton is filled and/or closed.

A still further object of the invention is to provide a carton having a divider insert connected to wall-forming portions of the carton to facilitate positioning the insert within the carton and which carton also contains an arrangement of integrally attached end-forming flaps adapted to close off the container ends.

Yet another object of the invention is to provide an improved storage and transport container, one form of which includes a divider insert in the form of an upwardly open tray having a bottom divider wall securing the packed objects against the bottom wall of the exterior container and wherein the insert sidewalls lie along the exterior container sidewalls to provide an auxiliary compartment.

A still further object of the invention is to provide an improved container, one form of which has a divider for the interior of the container to create two or more spaced apart side compartments and a center compartment or core, and wherein the insert walls dividing the container interior are positioned at their ends by spacer panels that determine the widths of the respective compartments.

A still further object of the invention is to provide a container wherein the cover assembly, the exterior wall-forming portions and the divider insert portions are all made from a single sheet of paperboard material containing straight cut and fold lines only, and which is constructed and arranged so as to provide automatic registration of flaps and walls in the proper position of assembly.

The foregoing and other objects and advantages of the invention are achieved in practice by providing a storage and transport container and a blank from which the finished container is made. The blank comprises a single sheet and includes panels providing exterior side and bottom walls, a cover element and an integrally attached insert portion which divides the container interior into two or more spaces and wherein the panels comprising the divider insert serve to locate at least one wall of the insert so as to assist such wall in engaging, positioning and/or retaining the contents of the container.

The exact manner in which the foregoing and other objects and advantages of the present invention are achieved in practice will become more clearly apparent when reference is made to the following detailed description of the preferred embodiments set forth by way of example and shown in the accompanying drawings, wherein like reference numbers indicate corresponding parts throughout.

DESCRIPTION OF THE PREFERRED EMBODIMENTS OF THE INVENTION

Figure 1:
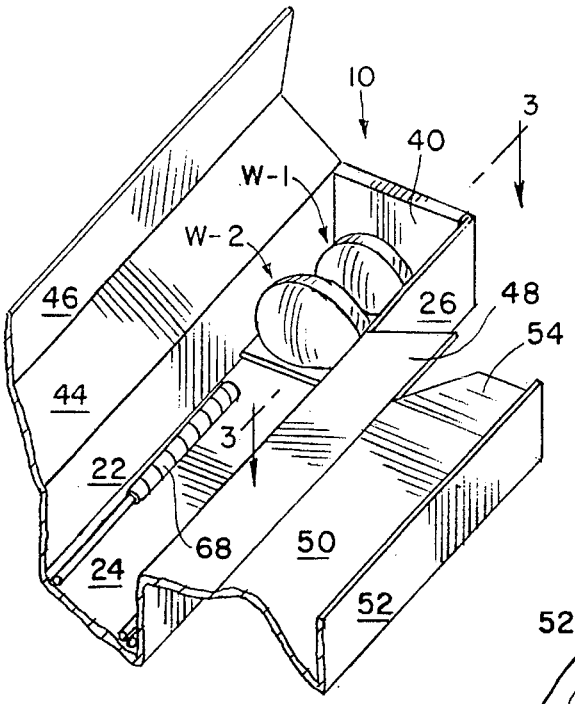
FIG. 1 is a fragmentary perspective view of one form of the storage and transport container made in accordance with the invention, showing how the container accommodates a set of golf clubs.

While the invention may be practiced in a number of forms and embodied in somewhat different styles of container, a pair of preferred embodiments will be described wherein the product to be carried is golf clubs having head and grip ends, and wherein the insert-forming panels are sufficiently shorter than the adjacent sidewalls of the exterior container so as intentionally to provide one or more compartments with end portions that are larger than the remainder of the compartments. The preferred material described herein is corrugated paperboard, although other materials may be suitable for the practice of the invention. Likewise, illustrative forms of the invention are shown wherein the interior is divided into two compartments and three compartments, respectively, but it is recognized that one or more additional interior compartments may be made using modified forms of the insert of the invention. Similarly, the form of end flap construction shown is preferred, although it is possible to achieve a satisfactory arrangement of end-forming panels in the manner different than that shown in the drawings, including the alternate forms described in the following text.

Figure 2:
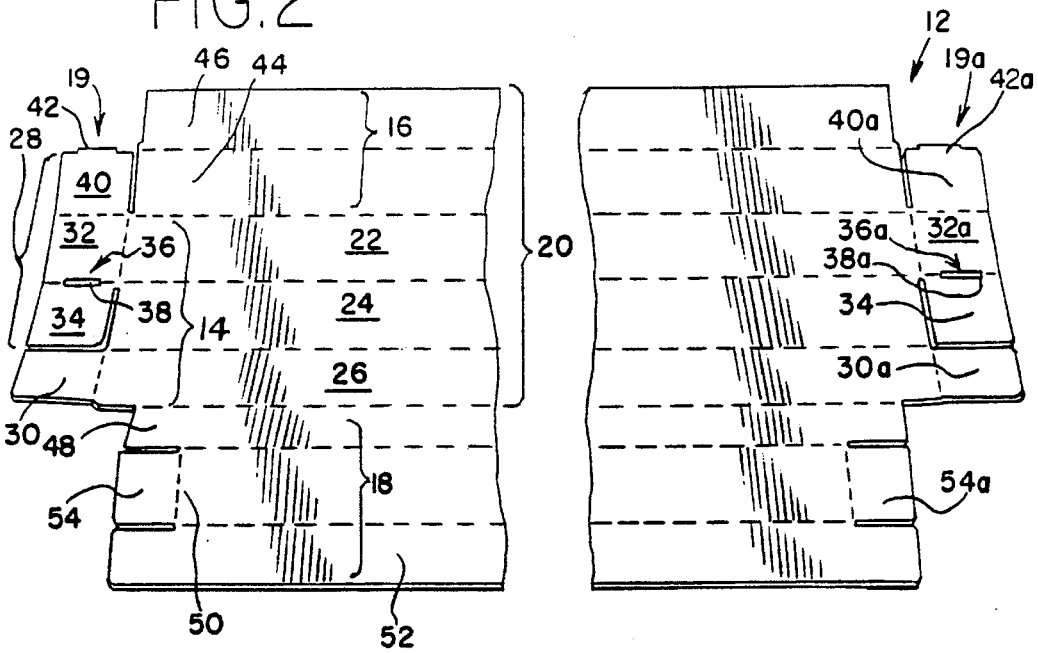
FIG. 2 is a perspective view of a corrugated paperboard blank from which the container of FIG. 1 may be erected by folding selected panels in an appropriate sequence.

Referring now to the drawings in greater detail, FIG. 1 is a perspective view of a portion of a shipping and storage container generally designated 10 embodying the invention and preferably made from a corrugated paperboard blank generally designated 12 (FIG. 2). When properly manipulated, the form of blank shown in FIG. 2 will form a shipping carton having its interior divided into a lower club compartment generally designated CC and an auxiliary compartment AC. In the form of container 10 shown here, the club compartment CC typically accommodates one to four golf clubs. In this form, two of the compartment walls snugly contact the club shafts so as to retain them in position within the box. The club heads and grips are protected against incidental scratches or other damage by being encased in plastic bags.

Figure 3:
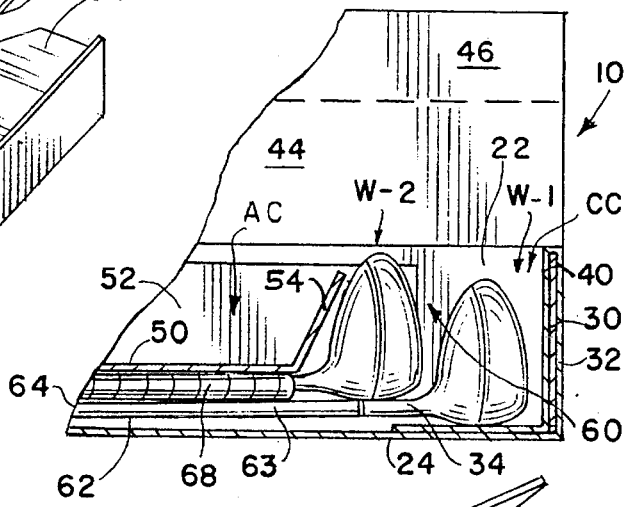
FIG. 3 is a vertical sectional view taken along lines 3—3 of FIG. 1 and showing a golf club set received in the container of FIG. 1 and positioned by the divider insert, prior to closing the container cover.

In the form of container shown as 10 in FIGS. 1–3, the various panels forming the blank 12 to be described are manipulated so as first to form an open box into which the goods are placed, and then the panels are further manipulated to form an insert that divides the interior into compartments and retains the clubs against movement. Thereafter, the cover-forming panels are manipulated to close the container for shipping and/or storage. In other embodiments, the divider/retainer insert may be positioned before the container is loaded.

Referring again to FIG. 2, the blank 12 is shown to comprise three principal sections, a wall-forming section 14, a cover-forming section 16, and an insert-forming section 18. Altogether, the wall- and cover-forming sections 14, 16 will comprise a container-forming section 20.

Referring again to FIG. 2, it will be seen that the wall-forming section 14 includes a first sidewall-forming panel 22, a bottom wall-forming panel 24 and a second sidewall-forming panel 26. Each of these panels is defined in part by pre-formed score lines which facilitate folding therealong prior to erecting, filling and forming the finished container. By "score line" is meant a line of weakness formed in the blank, usually by a steel rule die, as opposed to a "cut line", which refers to a line along which adjacent panels are cut to form free edges. The score lines become hinge or fold lines in the finished container.

In keeping with the invention, the container-forming section 14 includes a pair of identical end-forming assemblies generally designated 19, **19*a*, with the parts bearing the "a' suffix being mirror images of those bearing numbers only. Each of these assemblies 19, 19*a* being the same, only one assembly 19 will be described in detail. Here, the assembly 19 includes a multiple-flap portion 28 and a single flap portion 30. The multiple flap-forming portion 28 forms a part of the container end and comprises three elements, an outer end flap 32 joined by a fold or score line to the first sidewall-forming panel 22, and a pad flap 34 joined to the center flap along a pair of short score or fold lines and including a pair of spaced apart, parallel cut lines generally designated 36 which define a slot 38 lying along the locus of the score or fold line along which the center flap is joined to the pad flap 34**.

A locking flap 40 lies opposite the pad flap 34 and is also joined to the outer end flap 32 along a fold or score line lying parallel to the slot 38. The locking flap 40 further includes a locking tab 42 on its free edge, i.e. the edge opposite the slot 38 which will accommodate the tab 42. These elements ultimately cooperate with the single or inner end flap 30 to form one container end closure. As pointed out, each of the components 30–42 has an exact mirror-image counterpart **30*a*–42*a* lying on the opposite end of the wall-forming section 14**.

Referring again to FIG. 2, the cover-forming section 16 of the container blank 12 includes a main cover panel 44 and a cover flap 46. The length of all the panels in both the wall-forming and cover sections 14, 16 of the container blank 12 is substantially the same.

Referring now to the insert-forming portion 18 of the blank 12, this portion is shown in FIG. 2 to comprise three elongated wall-forming panels, an innermost insert panel 48, a center, holddown panel 50 and an outermost insert panel 50 with an edge portion forming the end of the blank opposite the edge of the cover flap 46. Preferably, a protector flap 54 is cut from an end portion of the center holddown panel 50, and a counterpart protector flap **54*a* may be formed on the other end of the panel 50*a***.

Referring now to the use of the carton, FIGS. 1 and 3 show that, in the assembled position, a pair of so-called "metal wood" golf clubs W-1 and W-2 are shown to be accommodated in the club compartment generally designated CC, with the various panels of the insert defining the insert forming an auxiliary compartment AC, which may typically accommodate club head covers (not shown).

Figure 3A:
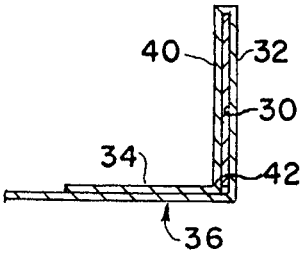
FIG. 3A is a fragmentary sectional view of the end portion of the container of FIGS. 1 and 3.

FIG. 3 thus shows certain of the various walls of the container 10 including a wall formed by the bottom panel 24, a sidewall formed by the panel 22, and the cover panel and closure flap 44, 46, respectively. FIGS. 3 and 3A also show the various end flaps 30, 32, 34, 40, making up an end section of the container.

Specifically, as shown in FIG. 3A, the flap 30 is entrapped between the outer end flap 32 and the locking flap 40, while the pad flap 34 overlies the bottom wall 24. Each flap thus locks a panel against an opening or unfolding movement. FIGS. 1 and 3 also show that the bottom wall 50 of the tray formed by the insert 18 extends substantially horizontally in use and is joined to the insert sidewall panel 52 which extends upwardly and terminates just short of the line along which the main cover panel 44 joins the sidewall panel 22.

The protector flap 54 is shown in an upturned position, partially covering the top surface of the club W-2. As shown, with the metal wood style golf clubs lying face down in the container 10, the club compartment CC includes full height and width end portions generally designated 60 (only one end shown in FIG. 3) and a reduced height section generally designated 62 and lying between the insert bottom wall 50 and the container bottom wall 24. Here, a load of three golf clubs is assumed and it is shown that the shafts 63, 64 of the clubs W-1, W-2 extend along and parallel to the grip portion 68 of another club, the head portion of which is understood to be disposed at the opposite end of the container but which is not shown in FIG. 3.

Figure 4:
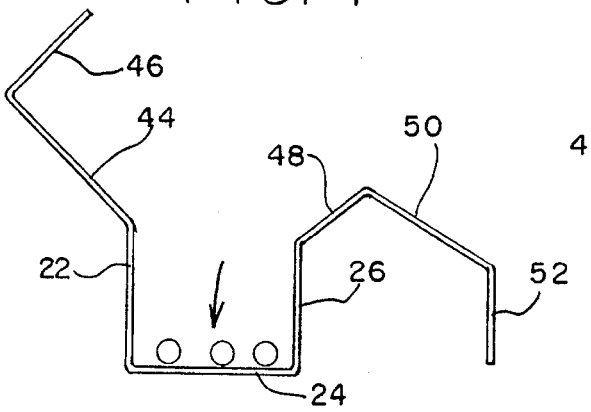
FIG. 4 is an end view, partially diagrammatic in nature, showing the process of filling the form of container shown in FIGS. 1–3 after forming the ends and prior to folding the insert and the cover.

Referring now to FIG. 4, the manner of assembling the container 10 is somewhat schematically illustrated. Here, it will be assumed that a carton blank 12 is oriented into the general position of FIG. 2, that is, laid on a flat surface and the matter of erecting the carton is to begin.

This process is best begun by folding the pad flap 34 90° upward from the plane of the flap 32, then rotating both flaps 32 and 40 about the fold line separating flap 32 from the sidewall-forming panel 22. Then, the flap 30 is folded 90° so as to lie parallel to flaps 32, 40. During this time, the sidewall-forming panels 22 and 26 are being folded upwardly towards each other, leaving the panel 24 lying generally horizontal so as to form the bottom wall of the being-formed container. This swings the pad flap 34 into position overlying panel 24 and positions the inner end-forming panel 30 inside the outer end-forming panel 32. This serves to position both sidewalls and also creates ends on the container which will then have an open center section. Thereupon, the container sidewalls are secured in their upright positions by moving the locking flap 40 downward until it is vertical and has entrapped the inner end flap 30 between itself and the outer end flap 32. As the locking flap 40 becomes vertical, the tab 42 on the end thereof moves into and engages the slot 38, locking the end flaps in place. The same operations are simultaneously performed on the opposite end of the end of the container 10 with elements 30*a*–42*a*. The side, bottom cover, and insert walls of the container 10 are then in the approximate position as shown in the diagrammatic view of FIG. 4.

Thereupon, the golf clubs are laid into the upwardly directed opening in container, with the club shafts 64, 66, 68 lying on the bottom wall 24. Next, with the clubs being thus positioned in what will prove to be club compartment CC of the container, suitable folds are made along the score lines separating the panels which will comprise the insert 18. Preferably, the lines separating the panels 26 and 48 is a double score line.

Figure 5:
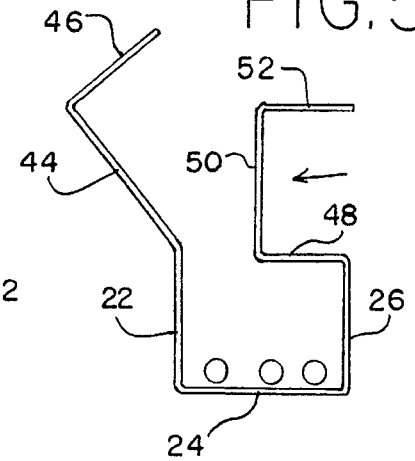
FIG. 5 is view similar to that of FIG. 4, and showing the insert being folded and moved toward its final position.

At any rate, the panels 48, 50, 52 are folded as indicated in FIG. 4. Then, as indicated in FIG. 5, the insert-forming assembly generally designated 18 and comprising panels 48, 50, 52 is folded as a unit about the hinged score line along which panel 26 joins panel 48. In the preferred form of structure, the panels 48, 52 are of equal length and are approximately one inch shorter than the height of the exterior wall panels 22, 26. The center holddown panel 50 has a width just slightly less than that of the bottom wall-forming panel 24.

Figure 6:
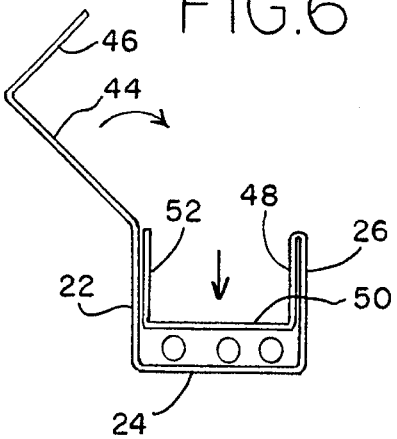
FIG. 6 is a view similar to FIG. 4 and 5, and showing the insert positioned so as to divide the container into separate compartments and to secure the load within the container.

Consequently, as shown in FIG. 6, when the rotation of the insert-forming unit 18 is complete, the sidewalls 48, 52 lie parallel to and in engaged and supported relation with the container exterior outer sidewall panels 22, 26. This upwardly opening, tray-like insert 18 thus holds the club shafts down and also defines three surfaces of the auxiliary compartment AC. In use, this compartment may accommodate other and related products such as club head covers, literature, promotional materials, or other suitable type of product.

Figure 7:
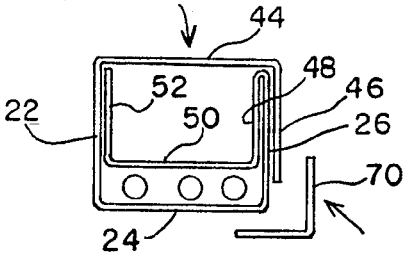
FIG. 7 is a view showing the assembled and filled container with the cover in the closed position.
Figure 10:
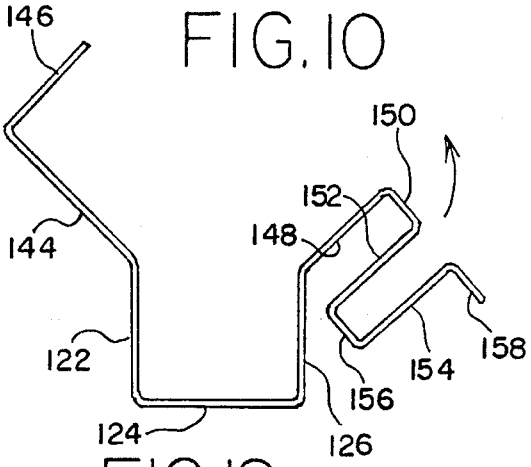
FIG. 10 is an end view, partly diagrammatic in character, and showing the first step in one preferred method of assembling the storage and transport container of FIGS. 8 and 9.
Figure 11:
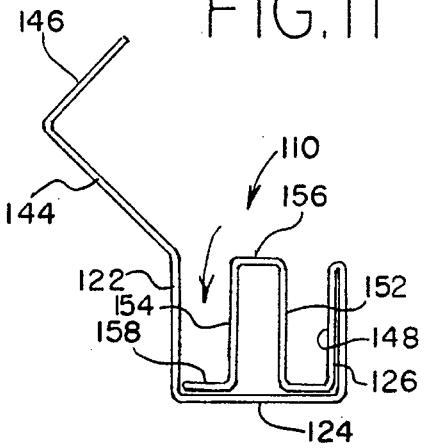
FIGS. 11–13 are end views, also partly diagrammatic in character, showing additional steps in the sequence of assembling the alternate form of container embodying the invention and shown in FIGS. 8 and 9.
Figure 12:
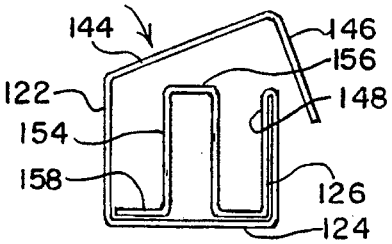

As is also shown in FIG. 6, after the holddown panel 50 is positioned horizontally, the main cover panel 44 and the flap 46 are rotated about the fold or score lines separating panels 22 and 44. This creates a closed container as shown in FIG. 7, with the panel 46 being positioned outside the outer sidewall 26 of the container 10. One or more auxiliary fasteners such as sections of tape 70 or the like may be used to secure the flap 46 in a closed position. When the carton is in its completed form, the protective flaps 54, 54*a* may be raised to accommodate the shape of the load and further protect the faces of the clubs in question.

As thus assembled and filled, the unit is extremely sturdy and resists bending in all directions. The container is formed from a single blank by a simple cut-and-score operation. All the fold lines are linear and the manner of erecting the carton is substantially foolproof.

By reason of being made from a single material, the package is readily recyclable. Its filling requires no judgment on the part of the packages. In other words, no pre-molded, custom fabricated or wadded, material, no holddowns, no staples or other fasteners are required to position the clubs or the like. The only club movement possible within the package is a very slight end-wise motion of the clubs. With the head portions of the metal woods being covered by a small plastic bag, the degree of movement and force thereof generated by shipping is insufficient to damage the clubs. As a result, the container can enjoy favorable freight and insurance rates, and more important, user satisfaction resulting from perceived high quality of the enclosed product.

Another advantage of the container made in this way is that, being substantially rectangular, it is easy to stack for storage and shipment. It requires no auxiliary provisions to be held in multiple package groups, as by banding, palletizing or the like.

Figure 9:
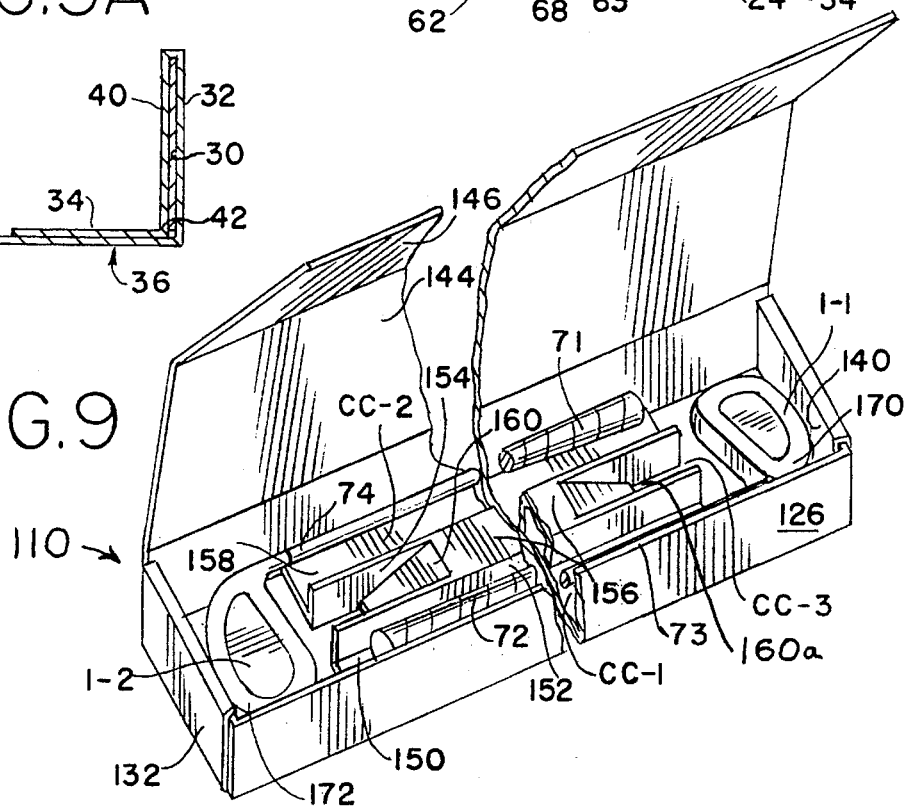
FIG. 9 is a fragmentary perspective view of a modified form of container made from the blank of FIG. 8, and showing the formation of the various compartments prior to the time that clubs or other products are placed therein.
Figure 8:
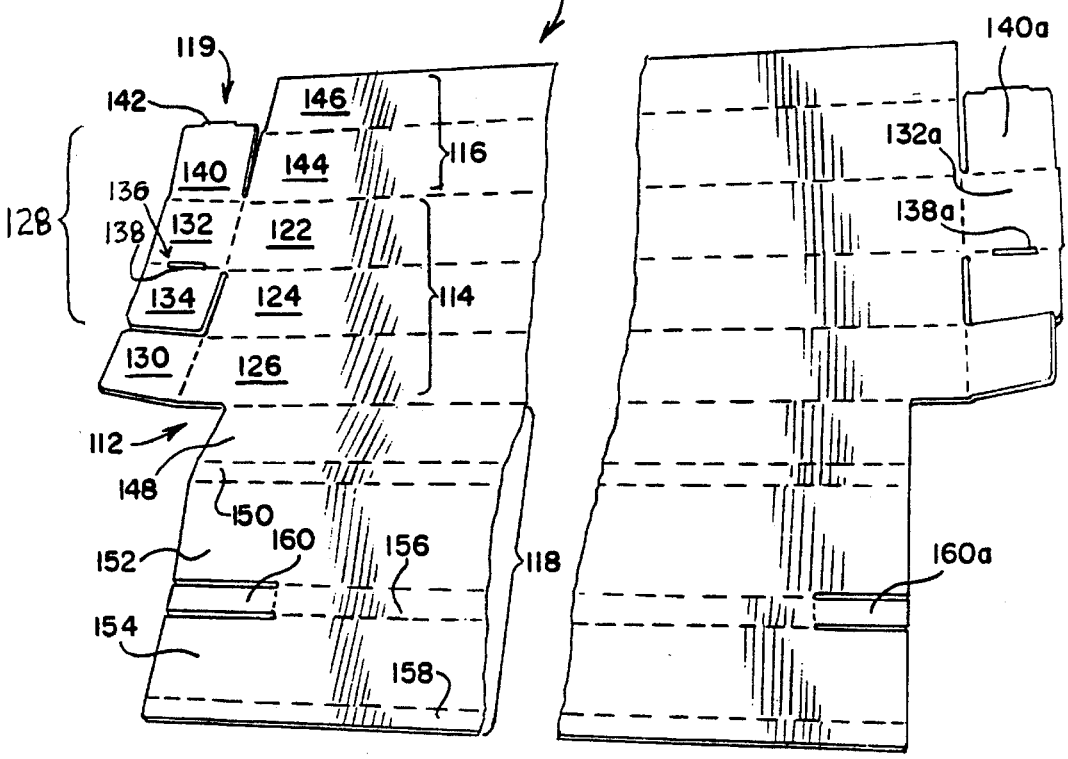
FIG. 8 is a fragmentary perspective view of a corrugated cardboard blank from which a modified form of container may be erected by folding selected panels in an appropriate sequence.

Referring now to another embodiment of the invention, a similar form of container generally designated 110 is shown in FIG. 8 to be made from a blank generally designated 112. As will appear, the comparted container of FIGS. 1–3 and the container of FIGS. 8–9 are similar in concept and execution, differing primarily in the configuration of the divider insert positioned therein. In this connection, the insert-forming section 120 of FIG. 8 includes six panels instead of three and is adapted to divide the container 110 into a pair of longitudinally extending club compartments CC-1 and CC-2, spaced from each other by a center core CC-3.

As in the earlier embodiment, the insert-forming panels are slightly less long than those of the wall and cover-forming panels. In this modified form of container, in lieu of the interior protective flap 52, forming a part of the end of the club compartment, the modified form of container shown in FIGS. 8–9 includes a pair of small flaps 160 that may be used to maintain the two walls forming a part of the club compartments in spaced apart relation.

Accordingly, and now referring to FIG. 8, the cover-forming section 116 and the wall-forming sections 114 are identical to their counterparts of FIG. 2, as are the end wall-forming components 119 that correspond to their counterparts 19 in FIG. 2. In other words, elements 122–146, inclusive of FIG. 8 are identical to elements 22–46 of FIG. 2.

Regarding the insert-forming section 118, this portion includes a total of six panels, namely, an innermost wall-forming insert panel 148, a first, offsetting or spacer panel 150, inner and outer core-forming wall panels 152, 154, connected by a second, upper spacer panel 156, and a third offsetting or spacer panel 158 having a long free edge parallel to the fold line dividing the panels 154, 158. Separator tabs 160, 160*a* are optionally provided to extend between and assist in keeping the core-forming panel walls 152, 154 spaced apart.

Figure 13:
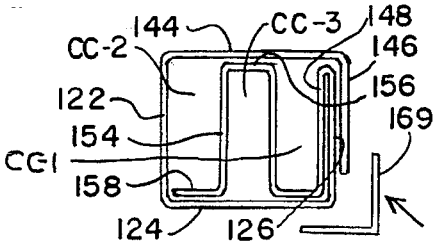

In this configuration, and referring now to FIG. 13, for example, it will be seen that the container in its finally erected form will contain a hollow center core 162 and a pair of spaced apart outer club compartments CC-1, CC-2. The walls 152, 154, in combination with the spacer panel 156, form the core, and these walls 152, 154 also cooperate with the outer wall panels 126, 122 to form the club compartments CC-1, CC-2, CC-3.

As in the previous example, the overall length of the panels 148–158 inclusive is slightly less than that of the wall and cover-forming panels, with the result being enlarged, club head-receiving compartments 170, 172 lying at each end of the modified form of container 110.

The erection and assembly sequence is the same as that generally described in connection with the embodiment of the container 10, except that, as illustrated in FIGS. 9–12, extra folds are required to create the insert-forming section 118. In the erected form of the container 110, the spacer panels 150, 158 contact the bottom wall 124 and overlie the pad flap 134, thus helping to retain the container in its erected condition. A tape 169 can be used the cover in place.

Inasmuch as the core CC-3 of this form of container is hollow, it may also accommodate materials other than clubs. The form of container illustrated in FIGS. 8–13, because of its additional interior panels, has even greater bending stiffness than the counterpart container 10. FIG. 9 shows plural "irons", designated I-1 and I-2, for example, with grips 71, 72 and shafts 73, 74 being shown in FIG. 9, for example.

The length of the interior wall-forming panels 152, 154 is such that there is positive engagement of the panels 150, 156, 158 by either the bottom wall 124 or the cover panel 144 of the container, and accordingly, it is not necessary to glue or staple any of the flaps in position for the container to retain its integrity during shipping. Likewise, the absence of auxiliary material such as staples, adhesives, and the like renders the package more readily recyclable and thus able to be more environment-friendly and ultimately be recycled at lower cost.

In the foregoing examples, it will be noted that the assumption has been made, in describing the container, that it is positioned in such a way as to have an upwardly open top portion so as to be loaded from the top. Of course, it is understood that such terms denoting orientation are relative only and that a container might be positioned such that the open portion lies on the side, etc. without departing from the spirit of the invention. Likewise, the manner of inserting the load into the container depends on the manner in which the container insert divides the container. For example, in the form of container shown in FIGS. 8–13, it would be possible to insert a part of the load in the core space before the insert is positioned and, after positioning the insert, fill the outer two compartments.

Additional panels joined by fold lines to the existing panels might be used to create additional compartments be vertical, horizontal or diagonal walls without departing from the spirit of the invention.

Two preferred embodiment of the invention having been shown and described in detail by way of example, it is understood that variations and modifications to the described form of product may occur to those skilled in the art and it is anticipated that changes and variations to the forms of container described herein may be made without departing from the spirit of the invention or the scope of the appended claims.

I claim:

1. A combination storage and shipment container made from a single blank of stiff, foldable sheet material, and being adapted to be loaded with product to be shipped through its open top during erection, said container comprising, in combination, a container section and a divider insert section, said container section having an exterior bottom wall panel and opposed, first and second exterior sidewall panels, with each of said panels being separated from adjacent panels by longitudinal fold lines, and a pair of opposed container section end portions each being formed by plural end flaps including an inner end flap attached to one of said first and second sidewall panels and an outer end flap attached to the other of said first and second opposed sidewall panels, with one of said end flaps including a pad flap joined thereto along a fold line and with one of said end flaps having a locking flap joined thereto along a fold line, with said pad flap being folded into overlying relation to said bottom wall panel, with said inner end flap being folded so as to lie inside said outer end flap and said locking flap being folded over said inner end flap and having a free edge in contact with said pad flap to secure both of said end flaps against movement, whereby said container section includes sidewalls, a bottom wall, opposed end portions and an open top, said container section also including a cover assembly comprising a top wall panel joined at a fold line along one of its edges to one of said first and second sidewall panels, a closure panel joined at a fold line to the other edge of said top wall panel, said divider insert section including a plurality of vertically and horizontally extending divider panels, with one of said divider panels being secured along a fold line to the other of said first and second container sidewall panels, and each of the remainder of said divider panels being of reduced length relative to the length of said sidewall and bottom wall forming panels and being joined to an adjacent divider panel along a fold line, with all said insert-forming divider panels being constructed and arranged to lie entirely within said container and with said one of said divider panels lying alongside said other of said first and second sidewall panels, when said container is erected, and with all of said divider panels being arrayed so as to divide said interior of said container into separate spaces, each of which is accessible throughout its entire length from the top of said container from time to time during positioning of said divider panels within said open container.

2. A combination container as defined in claim 1 wherein said divider insert panels are of reduced length relative to the length of said side, top and bottom wall panels of said container, whereby the end portions of the respective spaces formed defined in part by said divider insert are in communication with each other.

3. A combination storage and shipment container as defined in claim 1 wherein said stiff, foldable sheet material comprises corrugated paperboard.

4. A combination storage and shipment container as defined in claim 1 wherein said divider insert comprises three panels, a horizontally extending divider panel and a pair of vertical wall panels, said divider panels being adapted to divided the container interior into first and second interior spaces, and with said horizontal panel also being adapted to assist in positioning and securing materials disposed in said first space against movement.

5. A combination storage and shipment container as defined in claim 1 wherein said horizontal divider panel includes a protective flap at each of its ends, said protective flaps extending upwardly in use away from the plane of said horizontal divider panel.

6. A combination storage and shipment container as defined in claim 1 wherein said vertically and horizontally extending divider panels comprise three vertically extending wall-forming panels, all of just less than the same height as the height of said container exterior wall-forming panel, and three spacer panels with two of said three wall-forming divider panels being joined to each other by said spacer panels, and with all said panels being arranged in use so as to form first, second and third interior container compartments.

7. A combination storage and shipment container as defined in claim 6 wherein said spacer panels include a divider tab extending downwardly in use from the plane of one of said spacer panels, said divider tab engaging said divider wall-forming panels to prevent inward movement thereof.

8. A one-piece blank erectable into a top-loading combination storage and shipment container without auxiliary fasteners, said blank being made from a stiff, foldable sheet material and comprising, in combination, a container-forming section and a divider insert-forming section, said container-forming section having a bottom wall-forming panel and pair of sidewall-forming panels each joined to said bottom wall-forming panel along spaced apart edges of said bottom wall-forming panels by longitudinal fold lines, and a pair of opposed container section end-forming portions each including panels for forming inner and outer container end flaps, a pad flap and a locking flap, with said end flap-forming panels being attached respectively to said opposed sidewall-forming panels, and with said pad-forming panel being joined along a fold line to one end flap-forming panel and with one of said end flap-forming panels having a locking flap-forming panel joined thereto along a fold line, with said pad flap-forming panel being foldable into overlying relation to said bottom wall-forming panel, with said inner end flap-forming panel being foldable so as to lie inside said outer end flap-forming panel and said locking flap being foldable over said inner end flap and having a free edge adapted to contact said pad flap to secure both of said end flaps and said locking flap against movement when said container ends are formed, said container section also including a cover assembly comprising a top wall-forming panel joined at a fold line along one of its edges to one of said sidewall panels, a closure panel joined at a fold line joined to the other edge of said top wall panel, with said divider insert section including a plurality of vertically and horizontally extending divider panels, with one of said divider panels being a divider sidewall-forming panel secured along a fold line to the other of said container sidewall panels, and being arranged to lie along said other container sidewall-forming panel, and each of the remainder of said divider panels being of reduced length relative to the length of said container sidewalls and being joined to an adjacent divider panel along a fold line, with all said divider insert-forming panels being constructed and arranged so as to be folded in sequence into a position entirely within said container and to divide the interior of said container into separate spaces, said blank being constructed such that when said end flaps are locked, said container section presents an open top, and whereby each of said separate spaces of said container during erection is sequentially accessible throughout its entire length from said open container top.

9. A blank as defined in claim 8 wherein said plurality of walls comprising said divider insert comprises three panels, a horizontally extending divider panel and a pair of vertical wall panels, said divider panels being adapted to divided the container interior into first and second interior spaces, and with said horizontal panel also being adapted to engage in assist and positioning and securing materials disposed in said first space against movement.

10. A blank as defined in claim 8 wherein said vertically and horizontally extending divider panels comprise three vertically extending wall-forming panels, all of just less than the same height as the height of said container exterior wall-forming panel, and three spacer panels with two of said three wall-forming divider panels being joined to each other by said spacer panels, and with all said panels being arranged in use so as to form first, second and third interior container compartments.

11. A blank as defined in claim 8 wherein said sheet material comprises corrugated paperboard.

12. A blank as defined in claim 8 wherein said divider insert panels are of reduced length relative to the length of said side, top and bottom wall panels of said container, whereby the end portions of the respective spaces formed defined in part by said divider insert are in communication with each other.

13. A multi-compartment combination storage and shipment container made from a single blank of stiff, foldable sheet material, and being adapted to have each of its compartments be loaded with product through its open top during erection, said container comprising, in combination, a container section and a divider insert section, said container section having an exterior bottom wall panel and opposed exterior sidewall panels, with each of said panels being separated from adjacent panels by longitudinal fold lines, and a pair of opposed container section end portions each being formed by flaps attached to at least one of said opposed sidewall and bottom wall panels, with one of said flaps being a locking flap folded into overlying relation with at least one other flap, said container section also including a cover assembly comprising a top wall panel joined at a fold line along one of its edges to one of said sidewall panels, a closure panel joined at a fold line joined to the other edge of said top wall panel, said divider insert portion including a plurality of vertically and horizontally extending divider panels, with one of said divider panels being secured along a fold line to the other of said container sidewall panels, and each of the remainder of said divider panels being joined to an adjacent divider panel along a fold line, with all said insert-forming divider panels being constructed and arranged to lie entirely within said container and with said one divider panel secured to said other sidewall panel, when erected, lying alongside and parallel to said other sidewall panel, and with the remainder of said divider panels being of reduced length relative to the length of said container sidewall panels, said divider panels being arrayed so as to divide said interior of said container into separate spaces, all of which are accessible throughout their entire length from the top of said container during erection of said container.

* * * * *